US009825363B2

(12) United States Patent
Ghabra et al.

(10) Patent No.: US 9,825,363 B2
(45) Date of Patent: Nov. 21, 2017

(54) LOOP ANTENNA FOR PORTABLE REMOTE CONTROL DEVICE

(71) Applicant: Lear Corporation, Southfield, MI (US)

(72) Inventors: Riad Ghabra, Northville, MI (US); Chadi Shaya, Macomb, MI (US); Frank Buccinna, Livonia, MI (US)

(73) Assignee: Lear Corporation, Southfield, MI (US)

( * ) Notice: Subject to any disclaimer, the term of this patent is extended or adjusted under 35 U.S.C. 154(b) by 50 days.

(21) Appl. No.: 14/714,963

(22) Filed: May 18, 2015

(65) Prior Publication Data

US 2016/0344101 A1 Nov. 24, 2016

(51) Int. Cl.

| | |
|---|---|
| ***H01Q 21/00*** | (2006.01) |
| ***H01Q 7/00*** | (2006.01) |
| ***H01Q 1/38*** | (2006.01) |
| *G07C 9/00* | (2006.01) |

(52) U.S. Cl.

CPC ..... *H01Q 7/00* (2013.01); *H01Q 1/38* (2013.01); *G07C 2009/00547* (2013.01); *G07C 2009/00984* (2013.01)

(58) Field of Classification Search

CPC .. H01Q 7/00; H01Q 1/22; H01Q 1/38; H01Q 9/42; H01Q 21/30

USPC ..... 343/867, 866, 742, 728, 765, 732

See application file for complete search history.

(56) References Cited

U.S. PATENT DOCUMENTS

| | | | | |
|---|---|---|---|---|
| 5,592,182 | A | 1/1997 | Yao et al. | |
| 5,973,650 | A | 10/1999 | Nakanishi | |
| 6,518,877 | B1 | 2/2003 | Starkey et al. | |
| 7,310,069 | B2 | 12/2007 | Nantz et al. | |
| 7,548,216 | B2 | 6/2009 | Webb et al. | |
| 8,232,929 | B2 | 7/2012 | Ineichen et al. | |
| 2008/0191958 | A1* | 8/2008 | Belinguier | G06K 19/07749 343/867 |
| 2010/0283698 | A1* | 11/2010 | Orihara | G06K 19/07749 343/788 |
| 2011/0148573 | A1 | 6/2011 | Ghabra et al. | |
| 2015/0048994 | A1* | 2/2015 | Ma | H01Q 1/243 343/873 |
| 2015/0061940 | A1* | 3/2015 | Chen | H01Q 9/0421 343/700 MS |
| 2016/0336642 | A1* | 11/2016 | Makimura | H01Q 1/24 |

FOREIGN PATENT DOCUMENTS

| | | | |
|---|---|---|---|
| JP | 2005109609 | A | 4/2005 |
| JP | 2009290267 | A | 12/2009 |

OTHER PUBLICATIONS

Japanese Patent and Trademark Office, First Office Action Notification of Reasons for Refusal for Japanese Patent Application No. 2016-099177, dated Jul. 13, 2017, with English translation.

* cited by examiner

*Primary Examiner* — Dameon E Levi
*Assistant Examiner* — Collin Dawkins
(74) *Attorney, Agent, or Firm* — Brooks Kushman P.C.

(57) ABSTRACT

A remote control device includes a first loop antenna portion in the form of a printed metallic trace on a first side of a printed circuit board (PCB) and a second loop antenna portion in the form of a raised metallic structure on a second side of the PCB. The first and second loop antenna portions are connected together through the PCB to form a loop antenna.

16 Claims, 3 Drawing Sheets

LOOP ANTENNA FOR PORTABLE REMOTE CONTROL DEVICE

TECHNICAL FIELD

The present disclosure relates to antennas of portable remote control devices.

BACKGROUND

Some portable remote control devices include antennas for wireless communications. A keyfob ("fob") is an example of such a portable remote control device. A remote keyless entry (RKE) system includes a fob and a base station. The fob is carried by a user and the base station is at a target. The fob wirelessly communicates via its antenna with the base station to remotely control the target.

Requirements of the antenna of a portable remote control device such as a fob include providing satisfactory performance while satisfying packaging constraints.

SUMMARY

A remote control device such as a fob includes a printed circuit board (PCB) having first and second outer sides, a first loop antenna portion on the first side of the PCB, and a second loop antenna portion on the second side of the PCB. The loop antenna portions are of different forms from one another and are connected together to form a loop antenna.

The first loop antenna portion may be in the form of a printed metallic trace on the first side of the PCB and the second loop antenna portion may be in the form of a raised metallic structure on the second side of the PCB. In this case, the first loop antenna portion is in a plane parallel with the PCB and the second loop antenna portion is in a plane perpendicular with the PCB. The first loop antenna portion forms a part of a periphery of the loop antenna and the second loop antenna portion forms a remaining part of the periphery of the loop antenna. The parts of the periphery of the loop antenna formed by the first and second loop antenna portions correspond with one another to form a fully enclosed periphery of the loop antenna.

The first loop antenna portion includes first and second ends and the second loop antenna portion includes first and second ends. The first ends of the loop antenna portions are connected together and the second ends of the loop antenna portions are connected together to form the loop antenna.

The second loop antenna portion further includes a body between the first and second ends of the second loop antenna portion. The first and second ends of the second loop antenna portion are mounted to the second side of the PCB and the body of the second loop antenna portion is raised out and away from the second side of the PCB such that an air gap is between the body of the second loop antenna portion and the second side of the PCB.

The first side of the PCB may include componentry thereon such that a surface area of the first side of the PCB is insufficient for accommodating a full loop antenna in the form of a printed metallic trace on the first side of the PCB.

The first side of the PCB may have an insufficient amount of clearance for accommodating a loop antenna portion in the form of a raised metallic structure on the first side of the PCB.

A ground layer may be placed within the PCB between the first and second sides of the PCB. The ground layer is positioned such that none of the ground layer is interposed within a loop area of the loop antenna formed by the loop antenna portions.

Another remote control device includes a first loop antenna portion in the form of a printed metallic trace on a first side of a PCB and a second loop antenna portion in the form of a raised metallic structure on a second side of the PCB. The loop antenna portions are connected together through the PCB to form a loop antenna.

Another remote control device includes a first loop antenna portion in the form of a raised metallic structure on a first side of a PCB and a second loop antenna portion in the form of a raised metallic structure on a second side of the PCB. The loop antenna portions are connected together to form a loop antenna.

A system such as a remote keyless entry (RKE) system includes a base station and a portable remote control device. The portable remote control device includes a PCB having first and second outer sides, a first loop antenna portion on the first side of the PCB, and a second loop antenna portion on the second side of the PCB. The loop antenna portions are of different forms from one another and are connected together to form a loop antenna. The portable remote control device is configured to wirelessly communicate with the base station via the loop antenna.

The portable remote control device may be configured to wirelessly communicate remote engine start and/or stop control functions with the base station via the loop antenna.

DETAILED DESCRIPTION

Detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
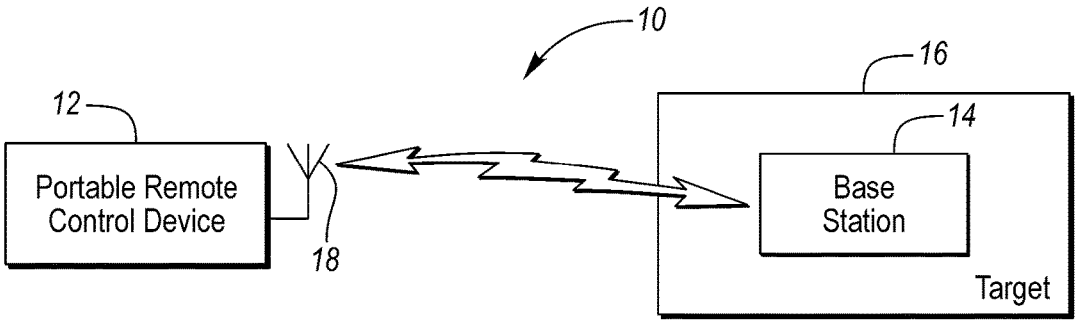
FIG. 1 illustrates a block diagram of an exemplary wireless remote control system having a portable remote control device.

Referring now to FIG. 1, a block diagram of an exemplary wireless remote control system 10 is shown. System 10 includes a portable remote control device 12 and a base station 14. Remote control device 12 is portable for being carried by a user. Remote control device 12 may be a keyfob ("fob"), a smart phone, a tablet, a wearable device such as a smart watch, or the like. Base station 14 is at a target 16. Base station 14 is configured to be able to control functions of target 16. Target 16 may be a vehicle, a house, a garage, a gate, a building, a door, a lighting system, or the like. Remote control device 12 and base station 14 are operable for wirelessly transmitting/receiving electro-magnetic (e.g., radio frequency (RF)) signals to/from one another to enable the remote control device to remotely control target 16 via the base station.

Remote control device 12 includes an antenna 18 through which the remote control device wirelessly transmits/receives the signals to/from base station 14 to remotely control the target. Base station 14 also includes a corresponding antenna (not shown).

One example of wireless remote control system 10 is its use in a remote keyless entry (RKE) system. In a RKE system, for instance, remote control device 12 has the form of a fob to be carried by a user and target 16 is a vehicle. RKE capability enables fob 12 to remotely control various functions of the vehicle in response to user actuation of buttons or the like of the fob. As an example, base station 14 unlocks a vehicle door in response to receiving a vehicle door unlock command from fob 12. Fob 12 transmits the vehicle door unlock command to base station 14 in response to corresponding user actuation of the fob.

Other control functions of the RKE system include two-way remote engine start/stop control functions. For the two-way remote engine start control function, fob 12 transmits an engine start command in response to user actuation of the appropriate button of the fob. In turn, base station 14 starts the engine of the vehicle and transmits an engine start status update to fob 12. The user of fob 12 is made aware from the engine start status update that the engine has been started. The two-way remote engine stop control function operates the same way for stopping the engine and notifying the user of same. As described, two-way remote engine start/stop control functions involve "two-way" communications between fob 12 and base station 14 as the fob and the base station both transmit/receive signals to/from one another.

A desire is for fob 12 to have a communications range on the order of 500 meters or more for performing two-way remote engine start/stop control functions. That is, fob 12 is to be able to communicate with base station 14 for performing two-way remote engine start/stop control functions when the fob is anywhere from the base station within the communications range. Antenna 18 of fob 12 therefore should have a configuration in which the antenna provides satisfactory radiation performance (e.g., gain, directivity, etc.) and meets electrical requirements (e.g., power consumption, efficiency, FCC operating regulations, etc.) for the fob to communicate with the base station over the desired communications range.

A problem is that antenna 18 is also subject to packaging constraints. Packaging constraints call for antenna 18 fitting within a relatively small packaging space of fob 12. Packaging constraints also call for antenna 18 consuming only a limited amount of surface area of a printed circuit board (PCB) having other componentry of fob 12.

In a typical RKE system, fob 12 and base station 14 communicate signals over an Ultra-High Frequency (UHF) band. For instance, the UHF operating frequency range is between 300 MHz to 3 GHz including a 300 MHz to 1 GHz operating range and a 315 MHz operating frequency.

Antenna 18 of fob 12 is therefore electrically short due to the noted packaging constraints and the relatively long wavelength associated with the chosen UHF operating frequency. As antenna 18 is shortened to meet the packaging constraints, the efficiency and impedance of the antenna become poor and difficult to manage. Such constrained configurations can result in antenna losses due to reduced radiation efficiencies which heretofore have made it elusive for fob 12 to have the desired communications range.

A portable remote control device such as a fob in accordance with the present disclosure includes a loop antenna in a configuration in which the antenna provides satisfactory radiation performance and meets electrical requirements while satisfying the noted packaging constraints. As such, a portable remote control device according to the present disclosure is able to communicate with a base station over the desired communications range (e.g., on the order of 500 meters or more) for performing control functions such as two-way remote engine start/stop control functions.

Referring now to FIGS. 2A, 2B, 2C, 2D, and 2E, a portable remote control device 20 such as a fob in accordance with the present disclosure will be described. Remote control device 20 includes a PCB 22 and a loop antenna 24. Loop antenna 24 includes a first loop antenna portion 26 and a second loop antenna portion 28. First and second loop antenna portions 26 and 28 together comprise loop antenna 24. That is, first and second loop antenna portions 26 and 28 are connected together in series to form loop antenna 24. First loop antenna portion 26 is associated with one side (e.g., a top side 30) of PCB 22 and second loop antenna portion 28 is associated with an opposite side (e.g., a bottom side 32) of the PCB.

Figure 2A:
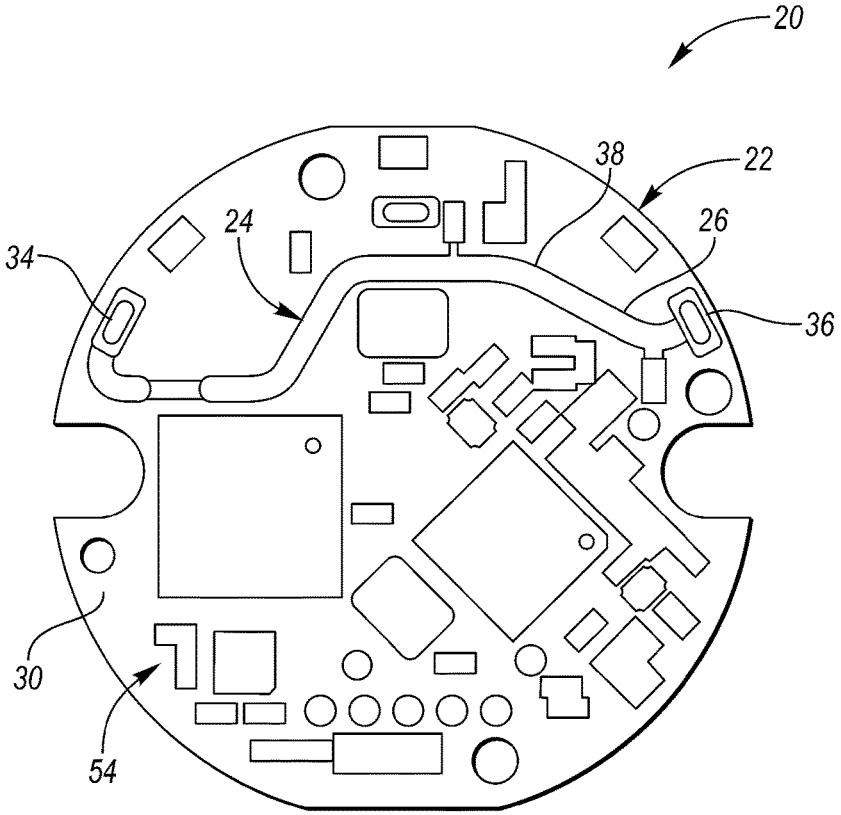
FIG. 2A illustrates a schematic view of the top side of a printed circuit board (PCB) of the remote control device with a loop antenna portion in the form of a printed metallic trace on the top side of the PCB.

FIG. 2A illustrates a schematic view of top side 30 of PCB 22. First loop antenna portion 26 is in the form of a printed metallic trace on top side 30 of PCB 22. The trace forming first loop antenna portion 26 is therefore in a plane parallel with PCB 22. The trace is fabricated as part of PCB 22. The trace includes first and second ends 34 and 36 with a body 38 extending therebetween. The trace thereby forms a part of the periphery of loop antenna 24 on the plane parallel with PCB 22, as shown in FIG. 2A.

Figure 2B:
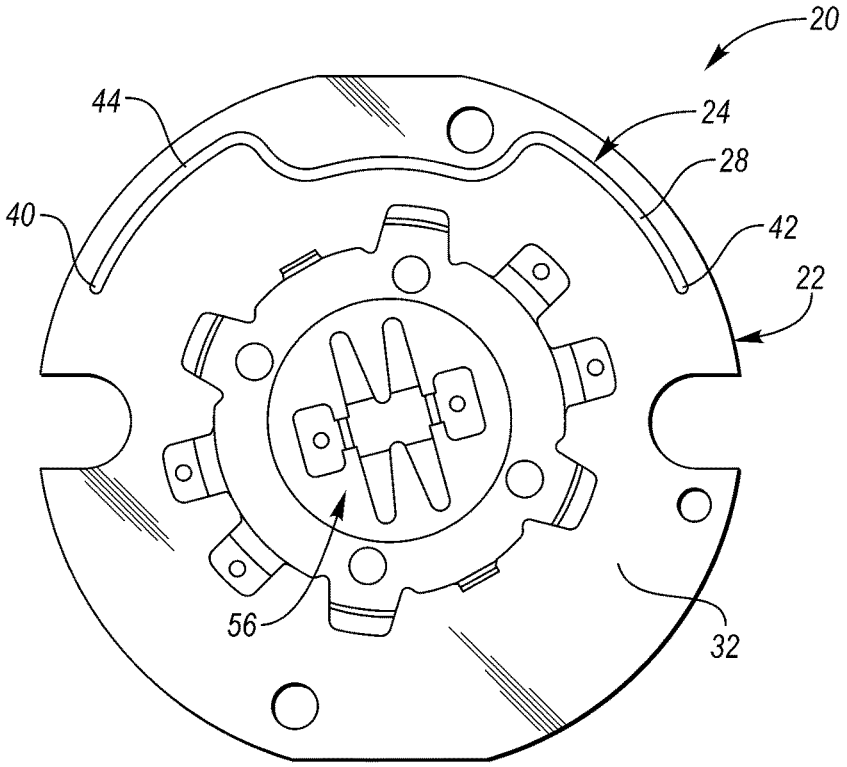
FIG. 2B illustrates a schematic view of the bottom side of the PCB with a corresponding loop antenna portion in the form of a raised metallic structure on the bottom side of the PCB.
Figure 2C:
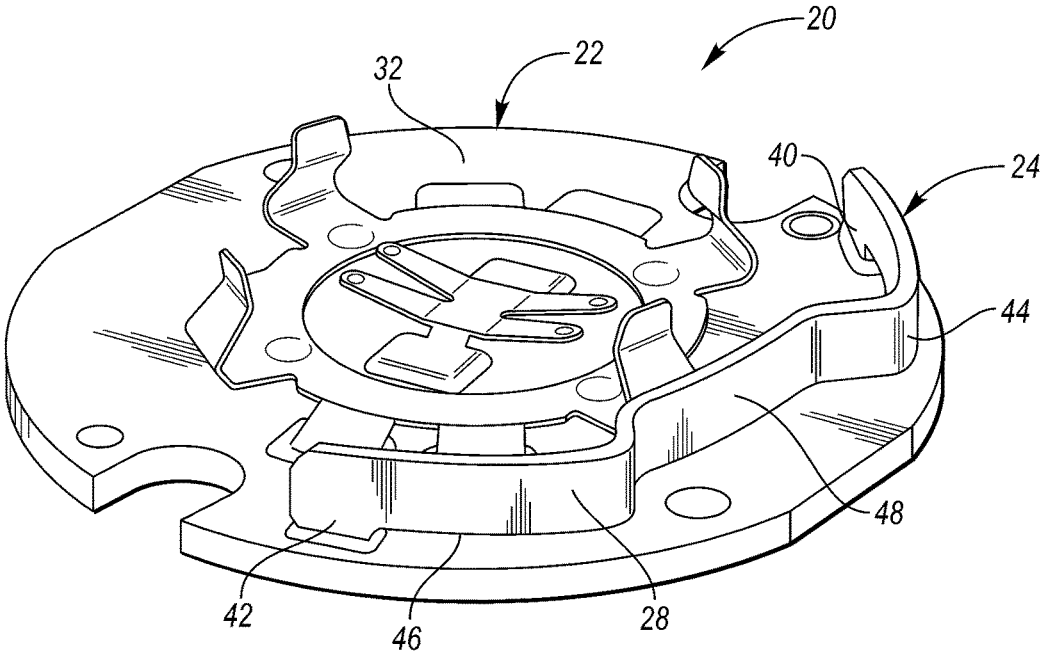
FIG. 2C illustrates a perspective view of the bottom side of the PCB.

FIGS. 2B and 2C respectively illustrate schematic and perspective views of bottom side 32 of PCB 22. Second loop antenna portion 28 is in the form of a raised metallic structure on bottom side 32 of PCB 22. The raised structure forming second loop antenna portion 28 extends out and away from bottom side 32 of PCB 22. For instance, the raised structure extends perpendicular out and away from bottom side 32 of PCB 22. The raised structure is therefore in a plane generally perpendicular with PCB 22.

The raised structure forming second loop antenna portion 28 includes first and second ends 40 and 42 with a body 44 extending therebetween. First and second ends 40 and 42 of the raised structure are mounted to bottom side 32 of PCB 22. Body 44 of the raised structure is raised out and away from bottom side 32 of PCB 22. The raised structure thereby forms a remaining part of the periphery of loop antenna 24 projected onto the plane parallel with PCB 22, as shown in FIG. 2B.

As body 44 of the raised structure is raised out and away from bottom side 32 of PCB 22, an air gap 46 is between body 44 of the raised structure and bottom side 32 of PCB 22. Any portion of body 44 of the raised structure may also be mounted to bottom side 32 of PCB 22 if desired (e.g., for enabling tuning). For instance, as shown in FIG. 2C, a middle section 48 of body 44 of the raised structure is mounted to bottom side 32 of PCB 22.

First end 34 of first loop antenna portion 26 and first end 40 of second loop antenna portion 28 are electrically connected together through PCB 22 (e.g., through a via extending through the PCB). Second end 36 of first loop antenna portion 26 and second end 42 of second loop antenna portion 28 are electrically connected together through the PCB (e.g., through another via extending through the PCB). In this way, first and second loop antenna portions 26 and 28 are connected in series and thereby form loop antenna 24.

In particular, first loop antenna portion 26 forms a part of the periphery of loop antenna 24 on the plane parallel with PCB 22 (shown in FIG. 2A) and second loop antenna portion 28 forms a remaining part of the periphery of the loop antenna projected onto the plane parallel with the PCB (shown in FIG. 2B). The parts of the periphery of loop antenna 24 formed by first and second loop antenna portions 26 and 28 correspond with one another to form a fully enclosed periphery of loop antenna 24 (shown in FIG. 2E). The loop area of loop antenna 24 is the area within the periphery of loop antenna 24.

As shown in FIGS. 2A, 2B, and 2C, PCB 20 includes componentry of the remote control device. The componentry includes, for example, processor circuitry, transceiver circuitry, light emitting diodes (LEDs), switches, and a battery. For instance, as shown in FIG. 2A, top side 30 of PCB 22 accommodates componentry including electronic chips for processor circuitry and transceiver circuitry, LEDs and switches. This componentry is generally designated with reference numeral 54. Correspondingly, as shown in FIGS. 2B and 2C, bottom side 32 of PCB 22 accommodates componentry including the battery. This componentry is generally designated with reference numeral 56.

As shown in FIG. 2A, componentry 54 consumes a relatively large amount of the surface area of top side 30 of PCB 22. As a result, a full loop antenna in the form of a printed trace cannot be accommodated on top side 30 of PCB 22. The remaining surface area of top side 30 of PCB 22 is simply not large enough for a printed trace to extend in a full loop layout to completely form a loop antenna on the top side of the PCB. Therefore, according to the present disclosure, only a portion of a full loop antenna (i.e., only first loop antenna portion 26) is on top side 30 of PCB 22. The remaining surface area of top side 30 of PCB 22 not consumed by componentry 54 is sufficiently large for first loop antenna portion 26 to extend as shown in FIG. 2A.

In a variation, the height above top side 30 of PCB 22 for accommodating componentry including loop antenna componentry is strictly limited. As a result, the available height above top side 30 of PCB 22 is simply not large enough for accommodating a loop antenna portion having the form of a raised structure. Accordingly, although a raised structure would consume minimal surface area of top side 30 of PCB 22, a printed trace is used as first loop antenna portion 26 on the top side of the PCB as the trace is essentially flat and fits within the available surface area of the top side of the PCB.

On the other hand, in this same variation, relatively more height above bottom side 32 of PCB 22 for accommodating componentry including loop antenna componentry is available. Accordingly, second loop antenna portion 28 is in the form of a raised structure as opposed to a trace. The raised structure forming second loop antenna portion 28 on bottom side 32 of PCB 22 in combination with the printed trace forming first loop antenna portion 26 on top side 30 of the PCB to form loop antenna 24 provide better antenna performance than a loop antenna formed by a pair of corresponding printed traces on respective sides of the PCB.

In another variation in which the height above top side 30 of PCB 22 for accommodating componentry including loop antenna componentry is not limited, the printed trace forming first antenna loop portion 26 may be replaced with a second raised structure.

Figure 2D:
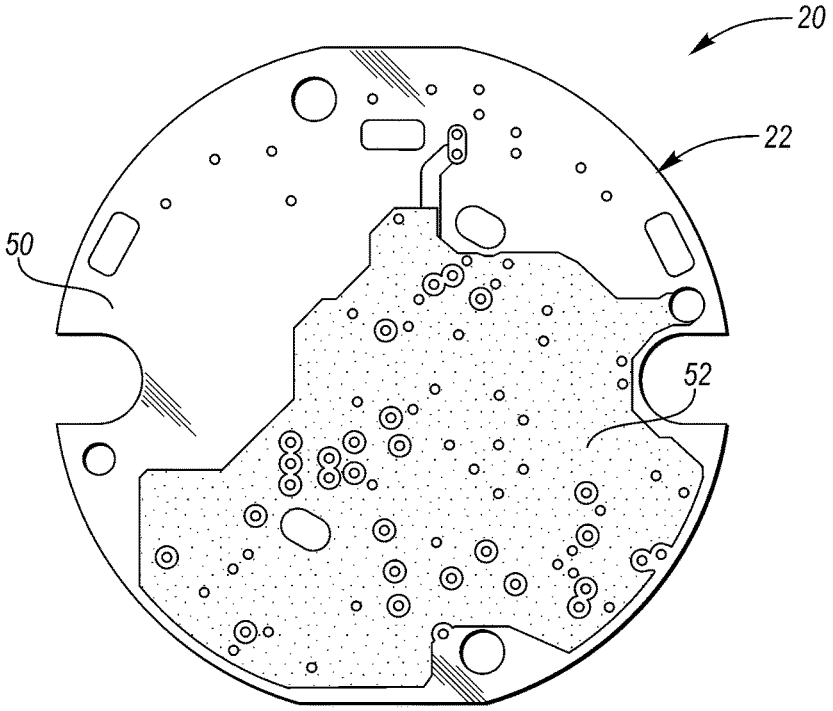
FIG. 2D illustrates a schematic view of an intermediate side of the PCB between the top and bottom sides of the PCB with a ground layer on the intermediate side of the PCB.

FIG. 2D illustrates a schematic view of an intermediate side 50 of PCB 22. Intermediate side 50 of PCB 22 is within the inside of PCB between top and bottom sides 30 and 32 of the PCB. A ground layer 52 is on intermediate side 50 of PCB 22. As shown in FIG. 2D, ground layer 52 covers a portion of the surface area of intermediate side 50. Ground layer 52 is not placed on the surface area of intermediate side 50 interposed between first loop antenna portion 26 on top side 30 of PCB 22 and second loop antenna portion 28 on bottom side 32 of the PCB. As a result, no ground plane is between first and second loop antenna portions 26 and 28. Further, ground layer 52 on intermediate side 50 is positioned such that space is between the ground layer and the surface area of intermediate side 50 adjacent to the surface area of the intermediate side interposed between first and second loop antenna portions 26 and 28.

Figure 2E:
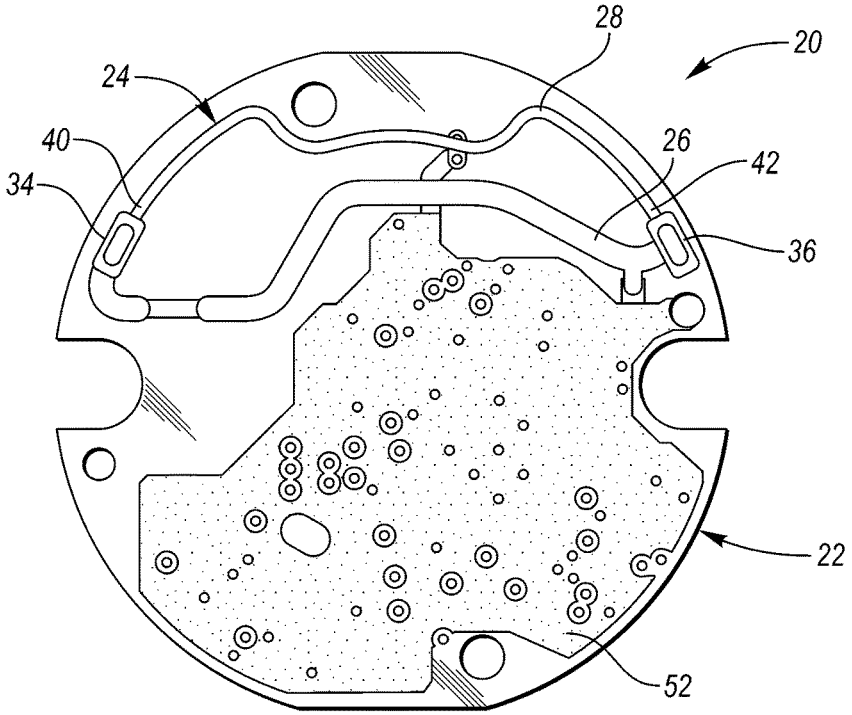
FIG. 2E illustrates a superimposed view of the top, intermediate, and bottom sides of the PCB.

FIG. 2E illustrates a superimposed view of top, intermediate, and bottom sides 30, 32, and 50 of PCB 22. The superimposed view of FIG. 2E is a simplified view highlighting loop antenna 24 and the positioning of ground layer 52. As shown, loop antenna 24 is comprised of first loop antenna portion 26 and second loop antenna portion 28 connected in series with one another. In particular, first ends 34 and 40 of first and second loop antenna portions 26 and 28, respectively, are electrically connected together through the PCB and second ends 36 and 42 of the first and second loop antenna portions, respectively, are electrically connected together through the PCB. First and second loop antenna portions 26 and 28 are at respective positions of top and bottom sides 30 and 32 of PCB 22 such that the loop antenna portions overlaid on one another (e.g., first loop antenna portion 26 on the plane parallel with the PCB (see FIG. 2A) and second loop antenna portion 28 projected onto the plane parallel with the PCB (see FIG. 2B)) form the loop of loop antenna 24 as shown in FIG. 2E.

As further shown in FIG. 2E, no portion of ground layer 52 is interposed between first and second loop antenna portions 26 and 28. Ground layer 52 is entirely spaced apart from the loop of loop antenna 24 formed by first and second loop antenna portions 26 and 28.

As described, a portable remote control device in accordance with the present disclosure includes a loop antenna formed by a combination of first and second loop antenna portions. The first loop antenna portion is associated with one of the top and bottom sides (e.g., the top side) of a PCB and the second loop antenna portion is associated with the other one of the top and bottom sides (e.g., the bottom side) of the PCB. The first loop antenna portion is in the form of a printed metallic trace on the top side of the PCB. The second loop antenna portion is in the form of a rigid metallic structure rising out from the bottom side of the PCB. An air gap is between the body of the raised structure and the bottom side of the PCB. The PCB is designed such that no substantial ground intersects the loop and such that no ground plane is close to either loop antenna portion.

A problem addressed by the present disclosure is the ability to form a loop antenna in a highly limited space on a PCB. The loop antenna according to the present disclosure solves this problem by being formed by the combination of the first and second loop antenna portions on the respective sides of a PCB.

The loop antenna formed by the first and second loop antenna portions may be a small UHF antenna for use in long range two-way remote engine start/stop applications where the required range may be on the order of 500 meters. Despite limited available space, the loop antenna has enough loop area to achieve the required range.

In general, a loop antenna should have a certain minimum (preferably optimum) loop area to achieve a minimum required antenna gain and pattern. If the loop area is too small, then there will not be enough gain. If the loop area is too large, then it will not be possible to make at resonant as the capacitance value required to resonate the loop will be impractically small. A loop antenna in accordance with the present disclosure takes these factors into account to achieve the required range.

While exemplary embodiments are described above, it is not intended that these embodiments describe all possible forms of the present invention. Rather, the words used in the specification are words of description rather than limitation, and it is understood that various changes may be made without departing from the spirit and scope of the present invention. Additionally, the features of various implementing embodiments may be combined to form further embodiments of the present invention.

What is claimed is:

1. A fob comprising:

a printed circuit board (PCB) having first and second outer sides;

a first loop antenna portion in a form of a printed metallic trace on the first side of the PCB and is in a plane parallel with the PCB;

a second loop antenna portion in a form of a raised metallic structure raised out and away from the second side of the PCB;

wherein the first and second loop antenna portions are connected together to form a loop antenna;

wherein the first side of the PCB includes componentry thereon such that a surface area of the first side of the PCB is insufficient for accommodating the loop antenna in the form of solely a printed metallic trace on the first side of the PCB; and wherein the first side of the PCB has an insufficient amount of clearance to enable a loop antenna portion in the form of a raised metallic structure raised out and away from the first side of the PCB to be on the first side of the PCB.

2. The fob of claim 1 wherein:

the second loop antenna portion is perpendicular with the PCB.

3. The fob of claim 1 wherein:

the first loop antenna portion forms a part of a periphery of the loop antenna and the second loop antenna portion forms a remaining part of the periphery of the loop antenna, the parts of the periphery of the loop antenna formed by the first and second loop antenna portions correspond with one another to form a fully enclosed periphery of the loop antenna.

4. The fob of claim 1 wherein:

the first loop antenna portion includes first and second ends and the second loop antenna portion includes first and second ends; and the first ends of the first and second loop antenna portions are connected together and the second ends of the first and second loop antenna portions are connected together to form the loop antenna.

5. The fob of claim 4 wherein:

the second loop antenna portion further includes a body between the first and second ends of the second loop antenna portion; and the first and second ends of the second loop antenna portion are mounted to the second side of the PCB and the body of the second loop antenna portion is raised out and away from the second side of the PCB with an air gap being between the body of the second loop antenna portion and the second side of the PCB.

6. The fob of claim 1 further comprising:

a ground layer placed within the PCB between the first and second sides of the PCB, wherein none of the ground layer is interposed within a loop area of the loop antenna formed by the first and second loop antenna portions.

7. The fob of claim 1 wherein:

the second loop antenna portion includes first and second ends and a body between the first and second ends; and the first and second ends are mounted to the second side of the PCB and a first portion of the body is raised out and away from the second side of the PCB with an air gap being between the first portion of the body and the second side of the PCB and a second portion of the body is raised out and away from the second side of the PCB in direct contact with the second side of the PCB with no air gap being between the second portion of the body and the second side of the PCB.

8. A device comprising:

a first loop antenna portion in a form of a printed metallic trace on a first side of a printed circuit board (PCB) and is in a plane parallel with the PCB;

a second loop antenna portion in a form of a raised metallic structure raised out and away from a second side of the PCB;

a ground layer;

wherein the first and second loop antenna portions are connected together through the PCB to form a loop antenna and none of the ground layer is interposed within a loop area of the loop antenna formed by the first and second loop antenna portions;

wherein the first side of the PCB includes componentry thereon such that a surface area of the first side of the PCB is insufficient for accommodating the loop antenna solely in the form of a printed metallic trace on the first side of the PCB; and wherein the first side of the PCB has an insufficient amount of clearance to enable a loop antenna portion in the form of a raised metallic structure raised out and away from the first side of the PCB to be on the first side of the PCB.

9. The device of claim 8 wherein:

the first loop antenna portion includes first and second ends and the second loop antenna portion includes first and second ends; and the first ends of the first and second loop antenna portions are connected together and the second ends of the first and second loop antenna portions are connected together to form the loop antenna.

10. The device of claim 9 wherein:

the second loop antenna portion further includes a body between the first and second ends of the second loop antenna portion; and the first and second ends of the second loop antenna portion are mounted to the second side of the PCB and the body of the second loop antenna portion is raised out and away from the second side of the PCB with an air gap being between the body of the second loop antenna portion and the second side of the PCB.

11. The device of claim 8 wherein:

the second loop antenna portion includes first and second ends and a body between the first and second ends; and the first and second ends are mounted to the second side of the PCB and a first portion of the body is raised out and away from the second side of the PCB with an air gap being between the first portion of the body and the second side of the PCB and a second portion of the body is raised out and away from the second side of the PCB in direct contact with the second side of the PCB with no air gap being between the second portion of the body and the second side of the PCB.

12. A device comprising:

a printed circuit board (PCB) having first and second outer sides;

a first loop antenna portion in a form of a printed metallic trace on the first side of the PCB and is in a plane parallel with the PCB;

a second loop antenna portion on the second side of the PCB;

wherein the first and second loop antenna portions are connected together to form a loop antenna;

wherein the second loop antenna portion is a raised metallic structure on the second side of the PCB;

wherein the first loop antenna portion includes first and second ends and the second loop antenna portion includes first and second ends and the first ends of the first and second loop antenna portions are connected together and the second ends of the first and second loop antenna portions are connected together to form the loop antenna;

wherein the first side of the PCB includes componentry thereon such that a surface area of the first side of the PCB is insufficient for accommodating the loop antenna solely in the form of a printed metallic trace on the first side of the PCB; and wherein the first side of the PCB has an insufficient amount of clearance to enable a loop antenna portion in the form of a raised metallic structure raised out and away from the first side of the PCB to be on the first side of the PCB.

13. The device of claim 12 wherein:

the device is a fob.

14. The device of claim 12 wherein:

the second loop antenna portion further includes a body between the first and second ends of the second loop antenna portion; and the first and second ends of the second loop antenna portion are mounted to the second side of the PCB and the body of the second loop antenna portion is raised out and away from the second side of the PCB with an air gap being between the body of the second loop antenna portion and the second side of the PCB.

15. The device of claim 12 further comprising:

a ground layer placed within the PCB between the first and second sides of the PCB, wherein none of the ground layer is interposed within a loop area of the loop antenna formed by the first and second loop antenna portions.

16. The device of claim 12 wherein:

the second loop antenna portion further includes a body between the first and second ends of the second loop antenna portion; and the first and second ends of the second loop antenna portion are mounted to the second side of the PCB and a first portion of the body is raised out and away from the second side of the PCB with an air gap being between the first portion of the body and the second side of the PCB and a second portion of the body is raised out and away from the second side of the PCB in direct contact with the second side of the PCB with no air gap being between the second portion of the body and the second side of the PCB.

* * * * *